US009456669B2

(12) United States Patent
Rydlewicz

(10) Patent No.: US 9,456,669 B2
(45) **Date of Patent: *Oct. 4, 2016**

(54) CUSHION SHAPED HEARTS AND ARROWS GEMSTONE AND METHOD

(71) Applicant: WORLDWIDE DIAMOND TRADEMARKS LTD., Vancouver (CA)

(72) Inventor: Roni Rydlewicz, Brussels (BE)

(73) Assignee: WORLDWIDE DIAMOND TRADEMARKS LTD. CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/011,447

(22) Filed: Aug. 27, 2013

(65) Prior Publication Data

US 2015/0020544 A1 Jan. 22, 2015
US 2016/0066663 A9 Mar. 10, 2016

Related U.S. Application Data

(63) Continuation of application No. 13/205,457, filed on Aug. 8, 2011, now Pat. No. 8,813,519, which is a continuation-in-part of application No. 11/286,218, filed on Nov. 23, 2005, now Pat. No. 7,992,410.

(60) Provisional application No. 61/846,817, filed on Jul. 16, 2013.

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/001
USPC ..... 63/32
See application file for complete search history.

(56) References Cited

U.S. PATENT DOCUMENTS

D522,908 S 6/2006 Horowitz et al.
D639,202 S * 6/2011 Gavin ..... D11/90

(Continued)

FOREIGN PATENT DOCUMENTS

CN 102078054 A 6/2011
WO 2012/164410 A1 12/2012

OTHER PUBLICATIONS

Office Action in Chinese Patent Application No. 201410339024.X, dated Jul. 22, 2015.

(Continued)

*Primary Examiner* — Emily Morgan
(74) *Attorney, Agent, or Firm* — Baker Hostetler LLP

(57) ABSTRACT

A diamond which will display a heart and arrows pattern characteristic substantially conforming to the hearts and arrows pattern inherently generated in a symmetrically polished round cut diamond when subjected to light. The diamond is polished in a symmetrical shape having four main crown facets on the long sides of the diamond, four main crown facets on the corner sides of the diamond, a table facet, 8 crown star facets adjacent the table facet, 16 crown half facets, 8 main pavilion facets, 16 pavilion half facets, 4 subsidiary pavilion facets, 16 subsidiary pavilion half facets with each subsidiary pavilion facet postioned adjacent two pavilion half facets and multiple girdle facets of varying thickness on both the long and corner sides of the diamond. The hearts and arrows pattern generated by this gemstone forms 8 symmetrically aligned arrows and 8 symmetrically aligned hearts when visually observed through a conventional scope in the presence of light.

12 Claims, 3 Drawing Sheets

(56) References Cited

U.S. PATENT DOCUMENTS

| | | | | |
|---|---|---|---|---|
| 7,992,410 | B2 * | 8/2011 | Rydlewicz | 63/32 |
| D688,970 | S * | 9/2013 | Rydlewicz | D11/90 |
| 2003/0221452 | A1 * | 12/2003 | Morbidoni | 63/26 |
| 2007/0113586 | A1 * | 5/2007 | Rydlewicz | 63/32 |
| 2011/0146350 | A1 | 6/2011 | Vets | |
| 2013/0019636 | A1 * | 1/2013 | Rydlewicz | 63/32 |
| 2013/0213090 | A1 * | 8/2013 | Ritchie | 63/32 |

OTHER PUBLICATIONS

Search Report in Taiwanese Design Application No. 102131514, dated Mar. 10, 2016.

* cited by examiner

CUSHION SHAPED HEARTS AND ARROWS GEMSTONE AND METHOD

CROSS-REFERENCE TO RELATED APPLICATIONS

This application is a continuation of U.S. patent application Ser. No. 13/205,457 filed on Aug. 8, 2011 which is a continuation-in-part of application Ser. No. 11/286,218 filed on Nov. 23, 2005, now U.S. Pat. No. 7,992,410 issued on Aug. 9, 2011.

FIELD OF THE INVENTION

The present invention relates to a new cushion shaped diamond which will yield a hearts and arrows pattern comparable to the hearts and arrows pattern generated in a perfectly symmetrical round shaped gemstone when the diamond is in the presence of light.

BACKGROUND OF THE INVENTION

No known gemstone currently exists having a rounded geometry with four curvilinear sides representing the long sides of the diamond which are interconnected to one another by four curvilinear corner sides of equal radius and a substantially square shaped table facet with the gemstone further possessing a multiplicity of subsidiary pavilion half facets which will yield a hearts and arrows pattern when subjected to light comparable to the hearts and arrows pattern generated in a perfectly symmetrical round shaped gemstone.

The cushion shaped diamond of the subject invention has a rounded geometry with four curvilinear long sides of substantially equal length interconnected by four curvilinear corner sides of equal radius with the four long sides of the diamond comprised of two pairs with each pair having parallel sides and with the diamond having a faceted girdle of varying thickness. In addition, the cushion shaped diamond has four main crown facets two of which lie adjacent each parallel pair, four main crown facets on the corner sides and sixteen crown half facets surrounding the four sides of the diamond. In addition, each main crown facet preferably has 10 girdle facets while each corner side preferably has 7 girdle facets.

SUMMARY OF THE INVENTION

The cushion shaped diamond of the subject invention comprises the following facets:

- 4 main crown facets of substantially equal geometry and dimension on the four long sides of the diamond
- 4 main crown facets of substantially equal geometry and dimension on the corner sides of the diamond
- 8 crown star facets on the main crown sides adjacent the square shaped sides of the table facet
- 16 crown half facets
- 1 square shaped table facet
- 40 girdle facets on the four long sides of the diamond
- 28 girdle facets on corner sides
- 8 main pavilion facets
- 16 pavilion half facets
- 4 subsidiary pavilion facets on the four long sides of the diamond
- 16 subsidiary pavilion half facets Total facets including girdle facets=145

Total facets excluding girdle facets=77

The proportions of the design are as follows:

Total depth: 67.5%-75%

Crown height: 14%-16.8%

Pavilion depth: 51.0%-53.7%

Table size: 53.0%-58.5%

Girdle thickness: 2.5%-7.5%

Length/width ratio: 1.0-1.007

Main Crown angle degree range: 34.2-35.1

Corner main crown angle degree range: 33.7-34.8

Main pavilion angle degree range: 40.6-41.1

Subsidiary pavilion angle degree range: 63-67.5

Pavilion halves angle degree range: 64.5-70.5

The faceting pattern of the cushion shaped diamond of the subject invention will yield a clear and perfectly symmetrical hearts and arrows pattern when the above facet arrangement and proportions are satisfied.

DETAILED DESCRIPTION OF A PREFERRED EMBODIMENT

Figure 1:
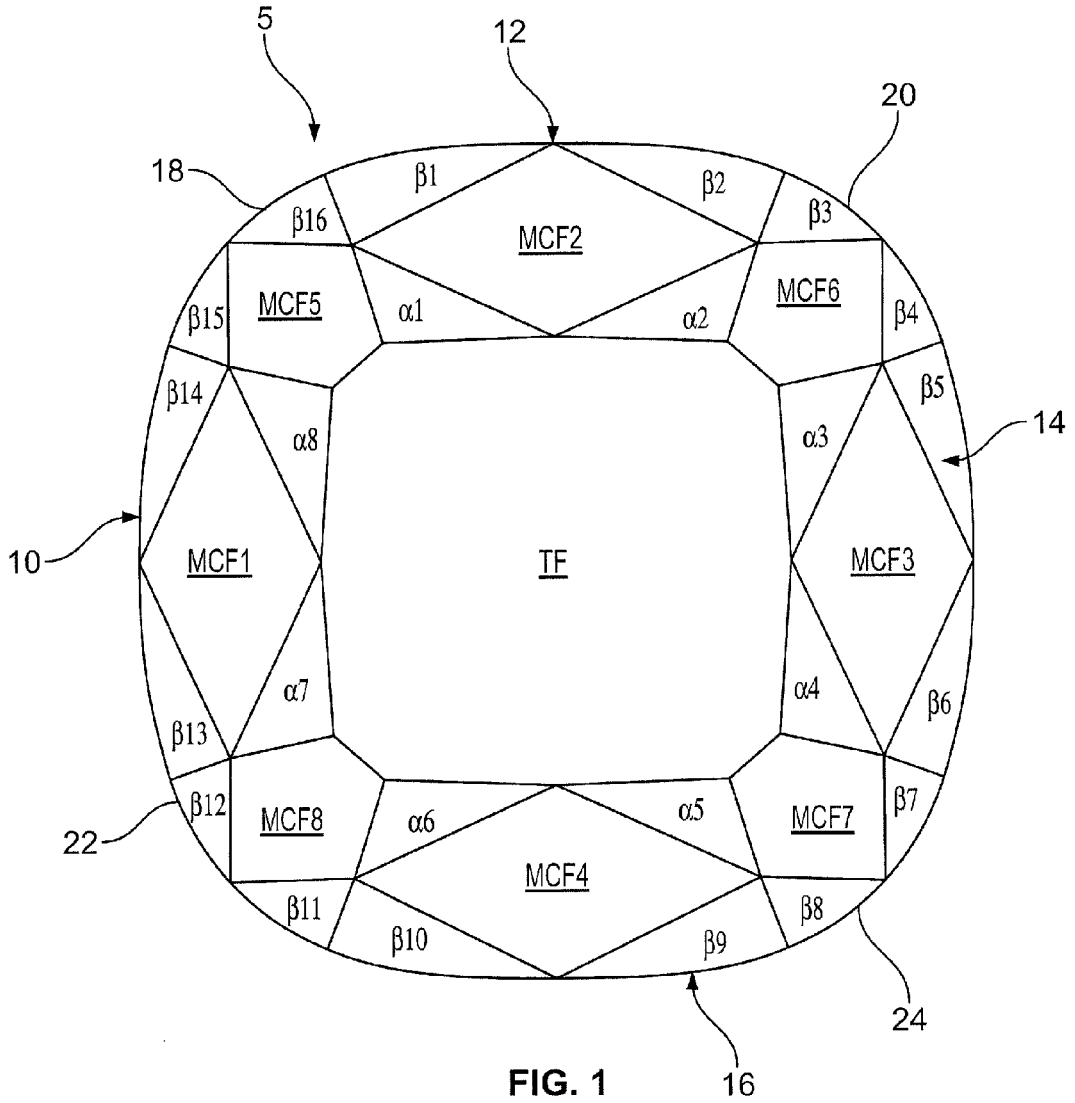
FIG. 1 is a top plan view of a gemstone showing my new design.
Figure 2:
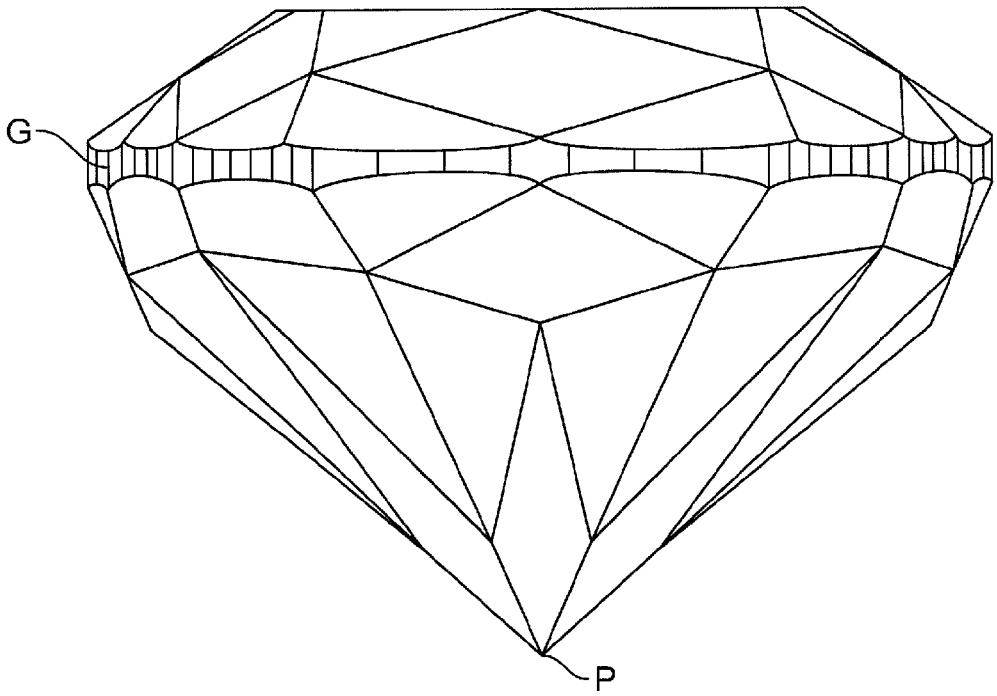
FIG. 2 is a side elevational view thereof.

As shown in the drawings, the cushion shaped diamond gemstone 5 of the subject invention has four curvilinear long sides 10, 12, 14 and 16 and four corner sides 18, 20, 22 and 24 of equal radius interconnecting the four curvilinear long sides. Each of the four long sides 10, 12, 14 and 16 has a slight curvature but is otherwise substantially straight and equal in length to one another so that the diamond forms a rounded shape geometry in combination with the four curvilinear corner sides 18, 20, 22 and 24 of equal radius. The two long sides 10 and 14 form a pair which lie in parallel and the two long sides 12 and 16 form a pair which lie in parallel. The four corner siders 18, 20, 22 and 24 are equal in dimension having a length significantly shorter than the comparative length of the four long sides 10, 12, 14 and 16. The four long sides 10, 12, 14 and 16 and the four corner sides 18, 20, 22 and 24 have a faceted girdle G of varying thickness as shown in FIG. 2.

Figure 3:
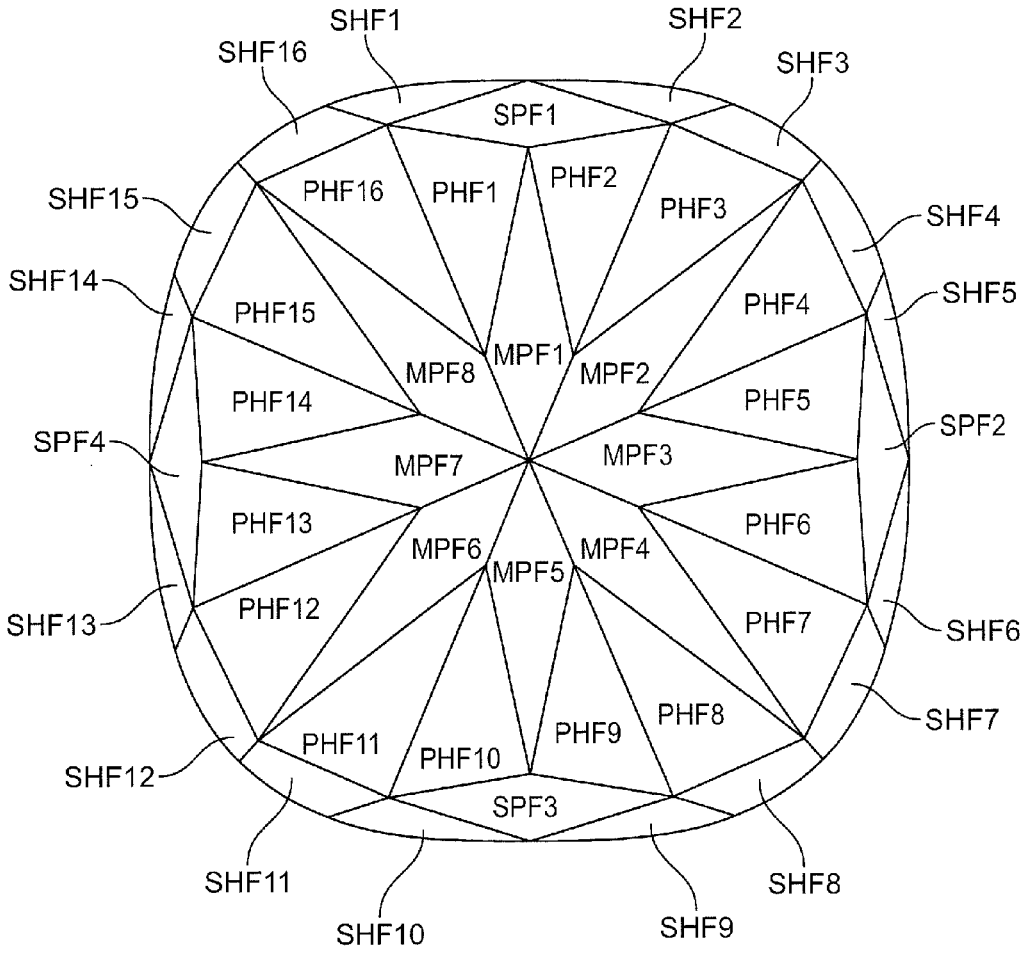
FIG. 3 is a bottom plan view thereof.

In addition, the gemstone 5 comprises one square shaped table facet TF having a beveled end on each of its 4 corners with the four beveled corners of the table facet TF positioned adjacent the 4 main crown facets MCF5, MCF6, MCF7 and MCF8 on the corner sides of the diamond. Another four main crown facets MCF1, MCF2, MCF3 and MCF4 lie on the four long sides and 4 main crown facets MCF5, MCF6, MCF7 and MCF8 on the corner sides. The 4 main crown facets MCF1, MCF2, MCF3 and MCF4 on the long sides are different in geometry and shape from the four main crown facets MCF5, MCF6, MCF7 and MCF8 on the corner sides, i.e., the distance between opposite longitudinal ends of the main crown facets MCF1, MCF2, MCF3 and MCF4 on the long sides are substantially greater than the distance between opposite longitudinal ends of the main crown facets MCF5, MCF6, MCF7 and MCF8 on the corner sides. Moreover, the 4 main crown facets MCF1, MCF2, MCF3 and MCF4 have only four sides whereas the four main crown facets MCF5, MCF6, MCF7 and MCF8 on the corner sides have five sides. Accordingly, the 4 main crown facets MCF1, MCF2, MCF3 and MCF4 on the long sides have a quadrilateral geometry and the 4 main crown facets MCF5, MCF6, MCF7 and MCF8 on the corner sides have a pentagon shape and is substantially smaller in area than the area of the 4 main crown facets MCF1, MCF2, MCF3 and MCF4 on the long sides. There are also 16 crown half facets β1-β16 surrounding the diamond main crown facet sides and eight star facets α1-α8 surrounding the table facet TF. Moreover, as shown in FIG. 3, the gemstone 5 further comprises four subsidiary pavilion facets SPF1, SPF2, SPF3 and SPF4 on the long sides and 16 subsidiary pavilion half facets SHF1-SHF16 surrounding the diamond. In addition the gemstone 5 includes 8 main pavilion facets MPF1-MPF8 and 16 pavilion half facets PHF1-PHF16 respectively. The subsidiary facets that are placed on the pavilion side allow for the gemstone 5 to be graded as "ideal" by the various Diamond Grading Institutes such as the Gemological Institute of America "GIA", the American Gemological Society "AGS" and the De Beers "Forevermark" Laboratory. Each main crown facet on one of the long sides has 10 girdle facets resulting in a total of 40 girdle facets on the long sides while each corner side has 7 girdle facets resulting in a total of 28 girdle facets on the corner sides, respectively.

The hearts and arrows pattern generated by the cushion shaped diamond gemstone 5 of the subject invention forms 8 perfectly symmetrical arrows and 8 perfectly symmetrical hearts when visually observed through a conventional scope as used by those skilled in the art in the presence of light.

The relationship and alignment between adjacent facets and between all crown and pavilion facets are paramount to yield a hearts and arrows pattern. All of the pavilion half facets and crown half facets have to be perfectly aligned with each other and the pavilion half facets should join each other at a point P. The design symmetry requirement is such that the polished diamond should obtain an Excellent grade by the various diamond grading institute. Any deviation from the design faceting pattern and any and/or all substantial deviation from the angle degree ranges set forth in the aforementioned proportions of the design may result in a light refraction pattern and brilliance level that will not yield a hearts and arrows pattern.

The cushion shaped design of the subject invention yields a brilliance level comparative to the brilliance level of perfectly cut round shaped gemstones and can score a brilliance mark higher than the highest possible mark on the various brilliance scopes used within the diamond industry comparative or better than the brilliance result with the most perfectly cut round diamonds.

What is claimed is:

1. A diamond comprising four long sides interconnected to one another by four corner sides forming a symmetrical shaped diamond possessing a hearts and arrows pattern characteristic of the true hearts and arrows pattern in a round cut diamond when subjected to light comprising: 4 main crown facets of substantially equal geometry and dimension symmetrically positioned on the four long sides of the diamond, 4 main crown facets of substantially equal geometry and dimension symmetrically positioned on the four corner sides of the diamond, a table facet, 8 crown star facets adjacent the table facet, 16 crown half facets, 8 main pavilion facets, 16 pavilion half facets, 4 subsidiary pavilion facets, 16 subsidiary pavilion half facets and multiple girdle facets on both the long and corner sides of the diamond wherein the hearts and arrows pattern generated by the diamond gemstone forms exactly 8 symmetrical aligned arrows and exactly 8 symmetrical aligned hearts when visually observed through a conventional scope in the presence of light.

2. A diamond as defined in claim 1 wherein the table facet has a substantially square shape with four cut corners.

3. A diamond as defined in claim 1 wherein the area of the 4 main crown facets on the long sides is greater than the area of the 4 main crown facets on the corner sides.

4. A diamond as defined in claim 1 wherein said four subsidiary pavilion facets are symmetrically positioned on the pavilion side of the diamond with each subsidiary pavilion facet positioned adjacent two pavilion half facets.

5. A diamond as defined in claim 1 wherein the girdle facets vary in thickness from 2.5%-7.5%.

6. A diamond as defined in claim 5 wherein there are 40 girdle facets on the four long sides of the diamond and 28 girdle facets on the four corner sides.

7. A diamond as defined in claim 1 wherein the four long sides are substantially equal in length and are arranged in pairs with each pair having substantially parallel sides.

8. A diamond as defined in claim 7 wherein the four corner sides have an equal radius resulting in the diamond being symmetrical and having a cushion cut configuration.

9. A diamond as defined in claim 8 wherein the four crown facets disposed on the long sides of the diamond have a geometry of substantially quadrilateral shape with two pairs of substantially parallel sides.

10. A diamond as defined in claim 9 wherein the main pavilion facets meet at a common point.

11. A diamond as defined in claim 10 wherein the main crown facets, pavilion facets and corner facets have the following cut angles:

main pavilion angle degree range: 40.6° -41.1°
main crown angle degree range: 34.2° -35.1°, and
corner main crown angle degree range: 33.7° -34.8°.

12. A diamond as defined in claim 11 wherein the subsidiary pavilion facets and the pavilion halve facets have the following cut angles:

subsidiary pavilion angle degree range: 63° -67.5°
pavilion halve angle degree range: 64.5° -70.5°.

* * * * *